United States Patent [19]

Broaddus et al.

[11] Patent Number: 4,712,988

[45] Date of Patent: Dec. 15, 1987

[54] APPARATUS FOR QUENCHING MELT SPRUN FILAMENTS

[75] Inventors: Clarke R. Broaddus; Bradley J. Gollhardt, both of Greenville, N.C.

[73] Assignee: E. I. du Pont de Nemours and Company, Wilmington, Del.

[21] Appl. No.: 20,019

[22] Filed: Feb. 27, 1987

[51] Int. Cl.[4] ..... B29C 35/06

[52] U.S. Cl. ..... 425/725; 264/211.14; 264/237; 425/464

[58] Field of Search ..... 264/177.17, 177.18, 264/177.19, 211.14, 211.15, 211.16, 211.17, 237; 425/66, 72 R, 72 S, 192 S, 378 S, 379 S, 382.2, 461–465

[56] References Cited

U.S. PATENT DOCUMENTS

| | | | |
|---|---|---|---|
| 2,252,684 | 8/1941 | Babcock | 425/72 S |
| 3,061,874 | 11/1962 | Lees | 425/72 R |
| 3,067,458 | 4/1959 | Dauchert | 264/211.15 |
| 3,070,839 | 1/1963 | Thompson | 425/72 R |
| 3,274,644 | 4/1964 | Massey et al. | 425/72 R |
| 3,299,469 | 1/1967 | Charlton | 425/72 S |
| 3,460,201 | 8/1969 | Zaitsev et al. | 425/72 R |
| 3,632,719 | 1/1972 | Nozawa | 264/211.15 |
| 3,745,061 | 7/1973 | Champaneria et al. | 428/398 |
| 3,834,847 | 9/1974 | Fletcher | 425/72 S |
| 3,999,910 | 12/1976 | Pendlebury et al. | 425/72 S |
| 4,444,710 | 4/1984 | Most, Jr. | 264/209.5 |
| 4,492,557 | 1/1985 | Ray et al. | 425/72 S |
| 4,631,018 | 12/1986 | Valteris et al. | 425/72 S |

FOREIGN PATENT DOCUMENTS

| | | | |
|---|---|---|---|
| 52-15692 | 5/1977 | Japan | 264/237 |
| 61-174411 | 8/1986 | Japan . | |

*Primary Examiner*—Jay H. Woo
*Assistant Examiner*—J. Fortenberry

[57] ABSTRACT

An apparatus for radially quenching melt spun filaments features a quenching chamber having a foraminous distribution cylinder between the filaments and the gas supply chamber with areas of decreasing porosity from a location immediately below the spinneret toward the exit of the quench chamber.

2 Claims, 3 Drawing Figures

APPARATUS FOR QUENCHING MELT SPRUN FILAMENTS

BACKGROUND OF THE INVENTION

This invention relates to melt spinning synthetic filaments and more particularly it relates to apparatus for radially quenching such filaments.

Dauchert, in U.S. Pat. No. 3,067,458, discloses an apparatus and process for melt spinning polymeric filaments and quenching the filaments by continuously directing a constant velocity current of cooling gas radially inward from all directions towards the filaments through a cylindrical hollow foraminous member surrounding the filaments and thence concurrently downward with the filaments. These radial quench systems provide a constant velocity radial flow from the top (near the spinneret) to the exit of the quench chamber.

When higher spinning productivity has been attempted using this radial quench system, and in particular with filaments having voids as disclosed in U.S. Pat. No. 3,745,061 (incorporated herein by reference) yarn quality, void content and uniformity have been adversely affected because of inadequate quenching of the filaments.

SUMMARY OF THE INVENTION

Improved quenching of melt spun filaments has been achieved by modifying the velocity flow from the top to the exit of the quenching chamber by providing a cylindrical foraminous gas distribution member with areas of decreasing porosity from a location immediately below the spinneret to the exit of the quench chamber. This can be accomplished by either varying the hole size or the hole density.

DETAILED DESCRIPTION OF THE ILLUSTRATED EMBODIMENT

Figure 1:
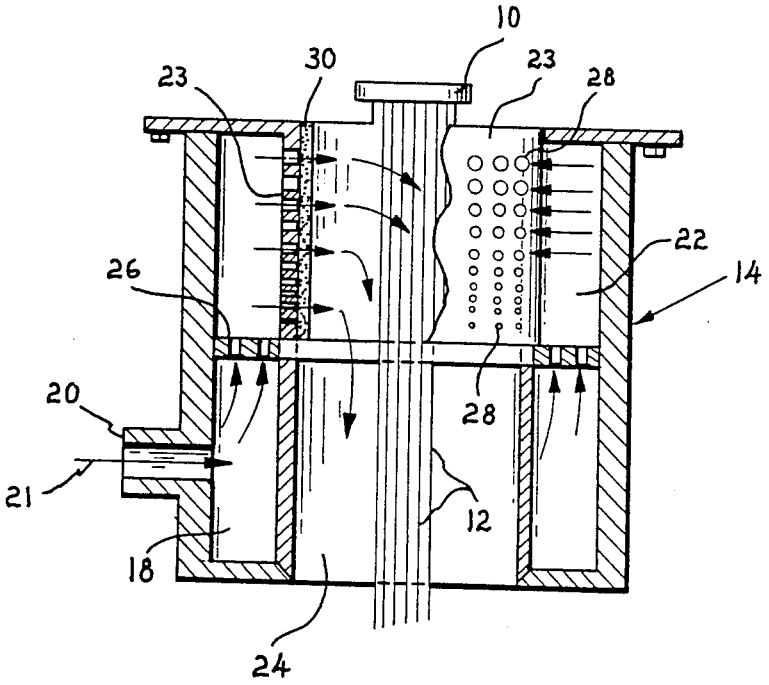
FIG. 1 is a sectional elevation view of a preferred embodiment of the invention.

Referring now to FIG. 1, the embodiment chosen for purposes of illustration includes a spinneret 10 through which a plurality of filaments 12 are extruded and then forwarded through a hollow cylindrical quenching chamber generally designated 14 to a guide (not shown) which comprises part of a conventional forwarding system. As shown, the hollow quenching chamber 14 is mounted immediately below the spinneret. The chamber 14 is provided with a lower annular chamber 18 having an inlet 20 for the introduction cooling gas 21 and an upper annular chamber 22 for distributing cooling gas into internal chamber 24 in the vicinity of the filaments 12. The chambers 18,22 are separated by a foraminous plate 26 that will distribute uniformly the gas entering into chamber 22. The inside wall 23 of chamber 22 is made of a cylindrical foraminous material, e.g., a cylindrical metal plate having holes 28 of varying diameters to provide areas of decreasing porosity from a location immediately below spinneret 10 toward the exit end of cylindrical plate 23 and a foam covering 30 to diffuse the air flow.

Figure 2:
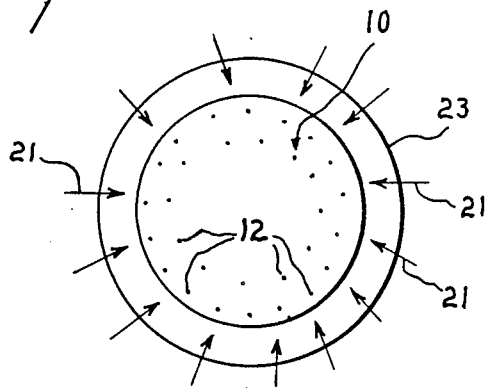
FIG. 2 is a schematic plan view of the quench distribution member.
Figure 3:
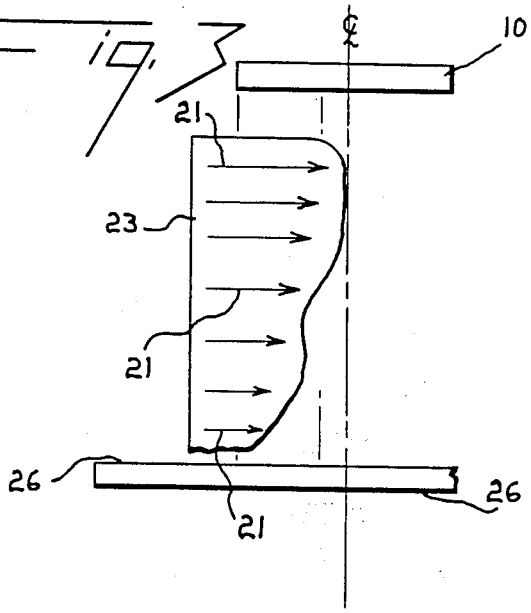
FIG. 3 is a schematic elevation view of the quench chamber showing the velocity profile attained with the invention.

In operation, gas 21 enters chamber 18 through inlet 20 then passes through distribution plate 26 into chamber 22. The gas then passes through foraminous cylinder 23 and into contact with the filaments (FIGS. 1 and 2) in a profile of decreasing velocity as shown in FIG. 3 wherein the length of arrows 21 correspond to velocity.

Test Procedures

Solution Relative Viscosity (LRV)

The term "LRV" is the ratio at 25° C. of the flow times in a capillary viscometer for a solution and solvent. The solution was 4.75 weight percent of polymer in solvent. The solvent is hexafluoroisopropanol containing 100 ppm $H_2SO_4$.

Percent Void Determination

Percent void is conveniently determined by measurement of flotation density as follows:

A series of solutions of varying density is prepared by combining the appropriate amounts of $CCl_4$, density 1.60 gm/cc, and n-heptane, density 0.684 gm/cc. Densities of these solutions may be determined accurately by measuring with a hydrometer. The solutions are lined up in order of increasing density. Then the apparent density of a hollow fiber is determined by cutting a short length (100–150 mm) of the fiber, tying it into a very loose knot, and immersing it in each of the solutions in turn to determine in which solution the fiber just floats and in which solution it just sinks. The average of these two densities is the apparent density of the fiber. Then percent void in the spun or drawn fiber is:

$$\text{Spun \% Void} = \frac{1.345 - \text{Apparent Density}}{1.345} \times 100$$

$$\text{Drawn \% Void} = \frac{1.39 - \text{Apparent Density}}{1.39} \times 100$$

Where:

1.345 is the polymer density in undrawn (amorphous) polyester fiber 1.39 is the polymer density in drawn (crystalline) polyester fiber

EXAMPLE I

This example illustrates the increase in hollow filament void content achievable with the apparatus of the invention.

The apparatus used is a conventional melt spinning unit in which molten polymer is fed to a spinning block fitted with gear pump and filter and spinneret pack. The extruded filaments pass through the quenching apparatus of the invention as illustrated in FIG. 1 and the quenched filaments are wound up or gathered with adjacent positions into a tow bundle and piddled into a can with conventional staple spinning equipment.

The 5½ inch diameter spinneret contains 212 capillaries which are arranged in four concentric circles with the diameter of the outer circle being 4.5 inches. The capillaries in the spinneret are of the type shown in FIG. 1 of U.S. Pat. No. 3,745,061.

The inside wall 23 (FIG. 1) of the quenching unit is a 7-inch diameter cylinder perforated with 24 equally-spaced horizontal rows of 117 holes each. The eight rows of holes nearest the spinneret have hole diameters of 0.076 inch, the middle 8 rows have hole diameters of 0.067 inch and the 8 rows farthest from the spinneret have hole diameters of 0.055 inch.

Polyethylene terephthalate having a solution relative viscosity (LRV) of 20.4 is melt spun using a spinning block temperature of 270° C., quenched and wound up at a speed of 700 yards per minute to give a yarn composed of hollow filaments having four continuous, non-round, parallel voids extending throughout their lengths. The denier of each filament is about 45. The yarn sample is coded A2.

The experiment is repeated using the same conditions and the same apparatus with the exception that perforated inner wall 23 of the quenching unit has holes which are all the same size. The total air flow is controlled so that it is the same as that used to make sample A2. The control hollow filament yarn prepared in this manner is labeled sample A1.

The percent void content of samples A1 and A2 are measured. The percent void of sample A1 is 20.5, while that of sample A2 is 25.9. It is apparent that use of the apparatus of the invention has provided a 26.3% increase in void content.

Also, visual inspection of photomicrographs of cross sections of test and control yarns prepared as above reveals a dramatic improvement in filament-to-filament denier uniformity in the test yarn.

EXAMPLE II

The procedure of Example I is repeated with the exception that the spinneret used has 388 capillaries arranged in five concentric circles and the windup speed is 1205 yards per minute. The quenching apparatus is similar to that used for sample A2. The yarn produced is composed of filaments having an as-spun denier of 14.5 and is coded B2.

A control yarn B1 is prepared using the same conditions and equipment as used for B2 with the exception that the quenching unit is similar to that used for control yarn A1.

Measurement of the void content of the two hollow fibers shows that the filaments of control yarn B1 have a percent void of 16.4 whereas those of test yarn B2 have a percent void of 23.8. Thus the use of the apparatus of the invention has provided a 45.1% increase in void content.

EXAMPLE III

This example illustrates the improvement in denier uniformity achieved with the apparatus of the invention.

Polyethylene terephthalate having an LRV of 20.4 is melt spun using a block temperature of 275° C. and a spinneret having 900 round holes arranged in eight concentric circles with the outer circle having a diameter of about 4.5 inches. The extruded filaments are quenched in air in a radial quenching unit and are then wound up at a speed of 1624 yards per minute to give a yarn in which the filaments have a spun denier of 3.6.

Using this procedure, a control yarn is prepared using a conventional radial quenching unit in which all of the holes in inside wall 23 (FIG. 1) are of the same size. A test yarn is prepared using a radial quenching unit similar to that used for sample A2 of Example I; i.e., a quenching unit in which inside wall 23 has larger holes in the area nearer the spinneret. Total air flow is kept the same for both yarns.

Samples of test and control yarns are crosssectioned, mounted on a microscope slide and the microscope image is projected on a large screen. For each sample, the diameter of each of 360 filaments is measured on the projected image, the results are recorded and both mean value and standard deviation are calculated. The control sample is found to have a mean filament diameter of 19.5 microns and a standard deviation of 1.852 while the test sample has a mean filament diameter of 19.5 microns and a standard deviation of 1.037. Comparison of the standard deviations indicates a filament-to-filament diameter uniformity improvement of over 40% for the test yarn.

We claim:

1. In an apparatus for melt spinning polymer that includes a spinneret, means for passing molten polymer through the spinneret, a hollow cylindrical foraminous member positioned immediately below the spinneret and a plenum chamber supplied with a current of gas surrounding the foraminous member to form a quench chamber for the filaments to pass through to its exit, the improvement for changing the gas distribution pattern inwardly toward the filaments in the chamber to a profile defined by maximum gas flow immediately below the spinneret decreasing to a minimum gas flow at the exit of the quenching chamber comprising: forming said hollow foraminous member of decreasing porosity from a location immediately below the spinneret toward the exit of the quench chamber.

2. The apparatus as defined in claim 1 wherein said cylindrical foraminous member is formed from a perforated plate with holes of decreasing diameter arranged from a location immediately below the spinneret to the exit of the quench chamber.

* * * * *